United States Patent [19]

Law

[11] Patent Number: 4,655,724

[45] Date of Patent: Apr. 7, 1987

[54] TOY VEHICLE AND STEERING AND DRIVE MECHANISM THEREFOR

[75] Inventor: Nin. Y. Law, Kowloon, Hong Kong

[73] Assignee: Soma International Ltd., Kowloon, Hong Kong

[21] Appl. No.: 813,916

[22] Filed: Dec. 27, 1985

[51] Int. Cl.[4] ..... A63H 17/385

[52] U.S. Cl. ..... 446/443; 74/665 GA; 74/810; 180/6.66; 180/233; 446/454

[58] Field of Search ..... 446/437, 442, 443, 454, 446/456, 457, 460, 462, 463, 469; 180/6.66, 233, 234, 248; 74/665 GA, 810, 812

[56] References Cited

U.S. PATENT DOCUMENTS

| | | | |
|---|---|---|---|
| 2,149,180 | 2/1939 | Muller | 446/442 |
| 2,730,182 | 1/1956 | Sloane | 180/6.66 X |
| 2,787,331 | 4/1957 | Tourneau et al. | 180/6.66 X |
| 3,052,311 | 9/1962 | Leedom | 180/6.66 |
| 4,232,479 | 11/1980 | Von Winckelmann | 446/457 |
| 4,443,968 | 4/1984 | Law | 446/462 |
| 4,508,516 | 4/1985 | D'Andrade et al. | 446/443 |
| 4,516,648 | 5/1985 | Berger et al. | 180/6.66 |
| 4,545,776 | 10/1985 | Law | 446/443 |
| 4,553,947 | 11/1985 | Weiland et al. | 446/443 |
| 4,577,528 | 3/1986 | Hanzawa | 74/665 GA |

*Primary Examiner*—Richard T. Stouffer

*Attorney, Agent, or Firm*—Buell, Ziesenheim, Beck & Alstadt

[57] ABSTRACT

A steering and drive system for toy vehicles is disclosed. Independent gear trains for wheels on opposite sides of the toy vehicle are utilized in combination with a single reversible motor to either rotate all wheels in the same direction to move the vehicle in a straight line or, by reversing the direction of the motor, to rotate wheels on opposite sides of the vehicle in opposite directions causing the vehicle to turn. Wheels on one side of the vehicle are connected to a main gear and the direction of rotation of such wheels is completely dependent upon the polarity of an electric power source applied to the motor. Wheels on the opposite side of the vehicle are indirectly connected to the main gear by a movable control gear which is urged to engage either an auxiliary gear or a second side drive gear so that the wheels rotate in only a single direction regardless of the direction of the motor.

10 Claims, 4 Drawing Figures

TOY VEHICLE AND STEERING AND DRIVE MECHANISM THEREFOR

BACKGROUND OF THE INVENTION

1. Field of the Invention

This invention relates to a steering and drive mechanism for toy vehicles. More specifically, the present invention provides a toy vehicle in which independent gear trains for wheels on opposite sides of the vehicle are utilized in combination with a reversible motor to either rotate all wheels in the same direction to move the vehicle on a straight line or, by reversing the direction of the motor, to rotate wheels on opposite sides of the vehicle in opposite directions causing the vehicle to turn.

2. Description of the Prior Art

Various forms of drive mechanisms have been proposed for toy vehicles. Some existing systems utilize gearing systems to provide a means to operate the toy vehicle in both forward and reverse directions. U.S. Pat. No. 2,149,180, for example, provides an automatic reversal for a toy vehicle. With that system, when an activating lever forming the bumper of the vehicle meets an obstacle, the lever urges an activating spur which changes the drive train from engagement with one gear into engagement with an oppositely spinning gear causing the vehicle to change its direction. The oppositely spinning gears engage one another and both are driven by a spring mechanism. A major shortcoming of this system is that the direction of the vehicle is changed only when the vehicle strikes an object.

U.S. Pat. No. 4,508,516 discloses a steering system for toy vehicles which also includes a reversible drive The steering system operates by providing a separate electrical motor for wheels on each side of the vehicle. By selectively providing resistance in the circuit of one of the motors, it is possible to operate one motor faster than the other causing the wheels on one side of the vehicle to turn faster than the wheels on the other side. Reversing the polarity of the motors in this system, however, merely causes the vehicle to operate in a reverse direction and does not affect a turning of the vehicle. While this system does appear to provide an effective manner of turning a toy vehicle, it requires the provision of complicated electrical circuitry and of two electric motors. These features make the vehicle relatively expensive and complex.

There remains the need for a steering and drive system for toy vehicles which only requires the provision of a single electric motor. There further remains a need for such a system which is simple in its design and cost effective to manufacture.

SUMMARY OF THE INVENTION

The present invention provides a steerable toy vehicle which has first and second wheels supported respectively on opposite sides of a chassis. A reversible electric motor, having a drive shaft extending therefrom, is also provided on the chassis. The drive shaft rotates in either a forward or reverse direction depending on the polarity of an electric power source connected to the motor. A main drive gear is operatively connected to the drive shaft and also may rotate in both forward and reverse directions. The main gear is connected to a first wheel on one side of the vehicle whereby reversing the polarity of the power source causes the first wheel to rotate in forward or reverse directions.

A second side drive gear is also provided. It is indirectly connected to the main gear by a direction control means so that the second side drive gear always rotates in a single forward direction regardless of the rotational direction of the main gear and the polarity of the power source. The second side drive gear is connected to a second wheel on the opposite side of the vehicle so that operation of the motor in a forward direction causes both the first and second wheels to rotate in the same direction and the vehicle to move forward in a straight line. Operation of the motor in a reverse direction causes the first and second wheels to rotate in opposite respective directions causing the vehicle to turn.

The control means of the present invention includes an auxiliary gear mounted to continuously engage the second side drive gear. The auxiliary gear rotates in an opposite direction with respect to the second side drive gear. The direction control means also includes a control gear means consisting of a spur gear and a smaller pinion attached to a face of the spur gear for rotation about a common axis. The control gear means is preferably mounted to a suitable bracket for pivotal motion about the main gear into which the spur gear is continuously engaged. Rotation of the main drive gear in a forward direction urges the control gear means to rotate about the main gear in a forward direction and causes the pinion to engage and directly drive the second side drive gear in a forward direction. Rotation of the main drive gear in a reverse direction, however, urges the control gear means to rotate about the main gear in a reverse direction and causes the pinion to engage the auxiliary gear which in turn engages the second side drive gear and drives the second side drive gear in the same forward direction.

From the foregoing, it can be seen that when the motor is operated in a forward direction, the vehicle moves forward in a straight line. When the direction of the motor is reversed, wheels on opposite sides of the vehicle rotate in opposite directions causing the vehicle to turn. The drive mechanism of the present invention, therefore, also provides an effective means in which to steer the vehicle.

In the presently preferred embodiment of the present invention, a vehicle having four wheels is provided wherein both wheels on each side of the vehicle are provided with power from the motor.

It is an object of the present invention to provide a steerable toy vehicle in which wheels on opposite sides of the vehicle may be selectively rotated by a single motor in both the same and in opposite directions.

It is another object of the present invention to provide such a toy vehicle in which the direction of the motor may be remotely controlled.

It is yet another object of the invention to provide a toy vehicle which utilizes the same mechanism to provide both power to the wheels and steering capabilities.

These and other objects of the present invention will be more fully understood from the following description of the invention and reference to the illustrations appended hereto.

DESCRIPTION OF THE PREFERRED EMBODIMENTS

Referring to the figures, the toy vehicle of the present invention includes a first pair of wheels including rear wheels 12 and 14 which are positioned substantially opposite one another and mounted on chassis 5 (partially shown in chain line) near one end thereof. At an opposite end of chassis 5, a pair of front wheels 16 and 18 are also preferably provided. The present invention may, however, include only one pair of wheels, one on either side of the chassis. In such a case, any type of additional support such as a ski or the like may be provided at an opposite end of the vehicle allowing the vehicle to move over a surface.

Figure 2:
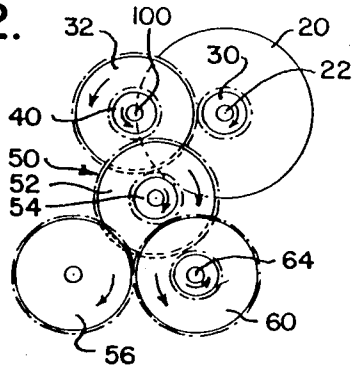
FIG. 2 is a partial cross-sectional view taken on the line II—II of FIG. 1 showing the control gear in a forward position.
Figure 1:
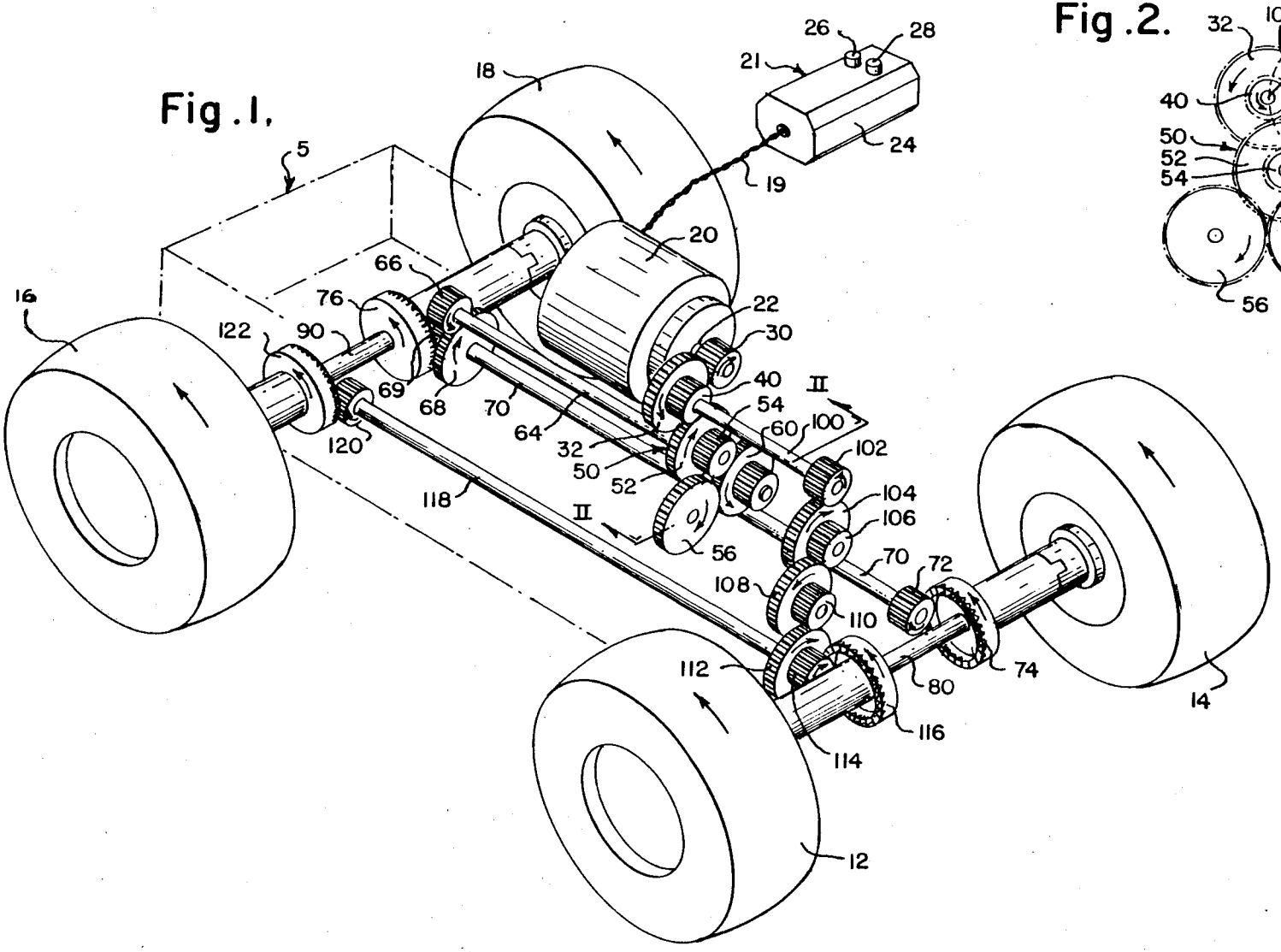
FIG. 1 is an isometric view of a present preferred embodiment of my steering and drive system when the gears are positioned to drive a vehicle in a forward direction.
Figures 3, 4:
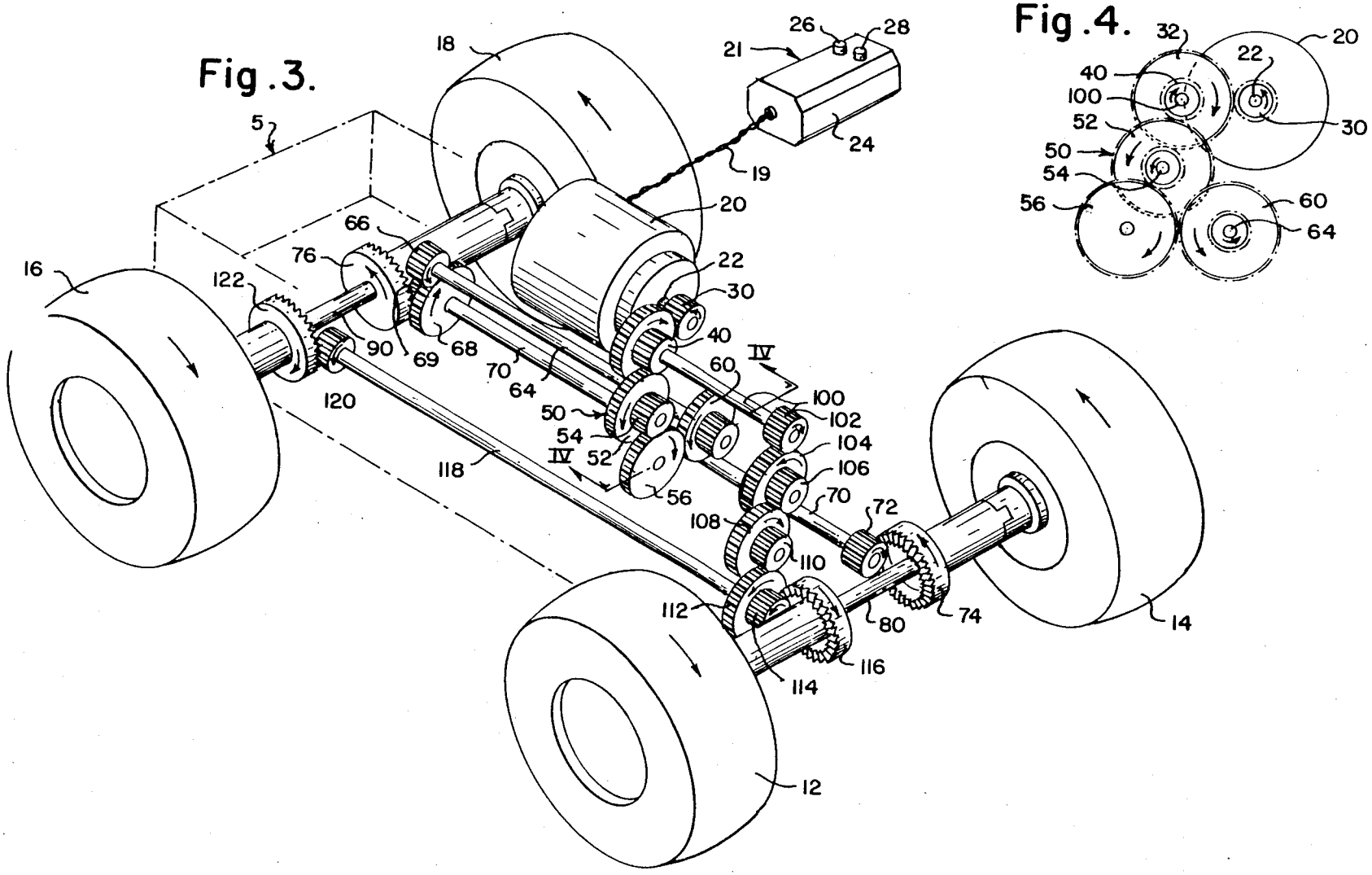
FIG. 3 is an isometric view of the steering and drive system of FIG. 1 when the gears are positioned to drive a vehicle in a reverse direction.
FIG. 4 is a partial cross-sectional view taken on the line IV—IV of FIG. 3 showing the control gear in a reverse position.

A reversible electric motor 20 is mounted on chassis 5. A drive shaft 22 extends from motor 20 and is adapted to rotate in both a forward and in a reverse direction. FIGS. 1 and 2 illustrate my steering and drive mechanism when motor 20 is operating in a forward, clockwise direction. FIGS. 3 and 4 illustrate my steering and drive mechanism when motor 20 is operating in a reverse, counterclockwise direction. A remote control unit 21 is attached to motor 20 by suitable wires 19. Control unit 21 preferably includes a housing 24 into which an electrical power source such as batteries are provided. Control unit 21 also preferably includes pressure activated buttons 26 and 28 which when depressed complete electrical circuits of opposite polarities and operate motor 20 in forward and reverse directions respectively.

Referring specifically to FIG. 1, the gear train of the toy vehicle of the present invention is shown as operating in a forward direction. Drive shaft 22, which extends from a rear end of motor 20, rotates in a forward, clockwise direction. Pinion gear 30 is provided on the end of drive shaft 22. A spur gear 32, with a pinion 40 attached to its face, engages pinion 30 and causes pinion 40 to rotate in a counterclockwise direction as shown. As will be more fully understood below, pinion 40 will hereinafter be referred to as the main drive gear of the present invention and it is operatively connected to drive shaft 22 through gear 32 and pinion 30. It will be obvious to those skilled in the art that any number of intermediate gears or none at all may be provided between drive shaft 22 and main drive gear 40.

Main drive gear 40 engages a control gear means 50 which is mounted for pivotal motion about the main gear and which consists of a spur gear 52 and a smaller pinion 54 attached to the face of spur gear 52 for rotation about a common axis. Spur gear 52 continuously engages main gear 40. However, pinion 54 may engage either gear 60 or gear 56. Pinion 54 is shown in FIGS. 1 and 2 engaging the second side drive gear 60. When control gear 40 is rotated in a forward, counterclockwise direction, control gear means 50 is adapted to rotate in a forward, clockwise direction about main drive gear 40 in a manner such that pinion 54 is urged by the rotation of main gear 40 into engagement with second side drive gear 60. Rotating main drive gear 40 in a reverse direction, however, causes control gear means 50 to rotate in a reverse counterclockwise direction about main gear 40 urging pinion 54 into engagement with auxiliary gear 56 as shown in FIGS. 3 and 4.

A shaft 64 is provided to connect second side drive gear 60 with pinion 66. Pinion 66 engages spur gear 68. A shaft 70 interconnects spur gear 68 with pinion 72. Pinion 72 drives crown gear 74 in a counterclockwise direction thereby driving wheel 14 in a forward, counterclockwise direction as shown in FIG. 1.

Spur gear 68 also has a pinion 69 attached to its face which engages crown gear 76 which drives wheel 18 in a counterclockwise, forward direction as shown in FIG. 1.

Wheels 12 and 14 are shown as supported and rotatable on a common axle 80. Axle 80 is preferably employed to maintain a proper alignment of wheels 12 and 14 although it will be obvious to those skilled in the art that a continous axle is not required. Likewise, common axle 90 is utilized to maintain a proper alignment of wheels 16 and 18.

A shaft 100 connects main drive gear 40 with pinion 102. Spur gears 104, 108 and 112 and pinions 106, 110 and 114 all cooperate to provide power directly from main gear 40 to crown gear 116 which acts to rotate wheel 12 in a counterclockwise, forward direction. A shaft 118 connects pinion 114 with pinion 120 which engages crown gear 122 to drive wheel 16 in a forward, counterclockwise direction.

Referring specifically to FIGS. 3 and 4, it can be seen that reversing the direction of motor 20 and motor drive shaft 22 causes wheels 12 and 16 on a first side of the vehicle to rotate in a clockwise, reverse direction. However, as indicated above, rotation of motor 20 in a reverse direction causes main drive gear 40 to rotate in a clockwise direction which urges control gear means 50 to rotate in a reverse, counterclockwise direction about main gear 40 such that pinion 54 disengages the second side drive gear 60 and engages auxiliary gear 56. Because auxiliary gear 56 engages second side drive gear 60, the end result is that reversing the direction of motor 20 has no effect on the counterclockwise, forward rotation of second side drive gear 60. Accordingly, regardless of the direction of rotation of motor 20, wheels 14 and 18 will always rotate in a counterclockwise, forward direction as shown in both FIG. 1 or FIG. 3.

From the foregoing it can be seen that operating the motor 20 in the forward, clockwise direction as shown in FIGS. 1 and 2 causes all four wheels 12, 14, 16 and 18 to rotate in a counterclockwise, forward direction and that reversing the polarity of motor 20 causes wheels 12 and 16 to reverse their direction but wheels 14 and 18 to rotate in same direction resulting in a torque on the vehicle making it turn about a circle.

Whereas particular embodiments of the invention have been described above for purposes of illustration, it will be appreciated by those skilled in the art that numerous variations of the details may be made without departing from the invention as described in the appended claims.

I claim:

1. A toy vehicle and steering and drive mechanism therefor comprising:

(a) a first and second wheel positioned substantially opposite each other;

(b) a reversible electric motor having a drive shaft extending therefrom, the rotational direction of which is responsive to the polarity of an electrical power source connected thereto;

(c) a main drive gear operatively connected to the drive shaft and adapted to rotate in forward and reverse directions depending on the polarity of the power source, said main gear operatively connected to the first wheel whereby reversing the polarity of the power source causes the first wheel to rotate in opposite directions; and (d) second side drive gear indirectly connected to the main gear by a direction control means positioned, sized and configured so that the second side drive gear always rotates in single direction regardless of the rotational direction of the main gear and the polarity of the power source, said second side drive gear operatively connected to the second wheel whereby operation of the motor in a forward direction causes the first and second wheels to rotate in the same direction and the vehicle to move in a straight line and reversing the polarity of the power source causes the motor to operate in a reverse direction and the first and second wheels to rotate in opposite directions causing the vehicle to turn.

2. A vehicle according to claim 1 wherein said direction control means further comprises:

(a) an auxiliary gear mounted to continuously engage the second side drive gear and rotate in an opposite direction with respect thereto; and (b) control gear means consisting of a spur gear and a smaller pinion attached to a face of tne spur gear for rotation about a common axis, said control gear means mounted for pivotal motion about the main gear into which the spur gear is continuously engaged whereby rotation of the main drive gear in a forward direction urges the control gear means to rotate about the main gear and causes the pinion to engage and directly drive the second side drive gear in a forward direction and rotation of the main drive gear in a reverse direction urges the control gear means to rotate about the main gear in a reverse direction and causes the pinion to engage the auxiliary gear which in turn engages the second side drive gear and drives the second side drive gear in a forward direction.

3. A toy vehicle according to claim 2 wherein said vehicle has two pairs of said first and second wheels, said pairs supported respectively on opposite ends of the vehicle, said main drive gear is connected to both of said first wheels on one side of the vehicle by a first gear means and said second drive gear is connected to both of said second wheels on the opposite side of the vehicle by a second gear means.

4. A toy vehicle according to claim 3 wherein said first gear means includes a separate crown gear connected to each of the first wheels for rotation therewith about a common axis of rotation, a first shaft spanning the distance between, said first wheels having a pinion attached to each end of said shaft, each said shaft-attached pinion engaging one of said crown gears and a spur gear mounted on said first shaft, said shaft-mounted spur gear connected by a suitable gear train to the main gear.

5. A toy vehicle according to claim 3 wherein said second gear means includes a separate crown gear connected to each of the second wheels for rotation therewith about a common axis of rotation, a second shaft spanning the distance between said second wheels having a pinion attached to each end of said shaft, each said shaft-attached pinion engaging one of said crown gears and on a spur gear mounted on said second shaft, said shaft-mounted spur gear connected by a suitable gear train to the second side drive gear.

6. A toy vehicle according to claim 2 also comprising a chassis to which said wheels are mounted.

7. A toy vehicle according to claim 1 wherein said vehicle has two pairs of said first and second wheels, said pairs supported respectively on opposite ends of the vehicle, said main drive gear is connected to both of said first wheels on one side of the vehicle by a first gear means and said second drive gear is connected to both of said second wheels on the opposite side of the vehicle by a second gear means.

8. A toy vehicle according to claim 7 wherein said first gear means includes a separate crown gear connected to each of the first wheels for rotation therewith about a common axis of rotation, a first shaft spanning the distance between said first wheels having a pinion attached to each end of said shaft, each said shaft-attached pinion engaging one of said crown gears and a spur gear mounted on said first shaft, said shaft-mounted spur gear connected by a suitable gear train to the main gear.

9. A toy vehicle according to claim 7 wherein said second gear means includes a separate crown gear connected to each of the second wheels for rotation therewith about a common axis of rotation, a second shaft spanning the distance between said second wheels having a pinion attached to each end of said shaft, each said shaft-attached pinon engaging one of said crown gears and a spur gear mounted on said second shaft, said shaft-mounted spur gear connected by a suitable gear train to the second side drive gear.

10. A toy vehicle according to claim 1 also comprising a chassis to which said wheels are mounted.

* * * * *

UNITED STATES PATENT AND TRADEMARK OFFICE

CERTIFICATE OF CORRECTION

PATENT NO. : 4,655,724

DATED : April 7, 1987

INVENTOR(S) : NIN Y. LAW

It is certified that error appears in the above-identified patent and that said Letters Patent is hereby corrected as shown below:

Column 1, line 35, after "drive" insert "."

Column 4, line 54, after "in" insert --the--.

Column 5, line 31, change "tne" to --the--.

Column 6, line 5, after between delete ",".

Signed and Sealed this

Eleventh Day of August, 1987

*Attest:*

DONALD J. QUIGG

*Attesting Officer*

*Commissioner of Patents and Trademarks*